United States Patent [19]

Sato

[11] 4,267,654

[45] May 19, 1981

[54] TAGS FOR USE WITH STAPLERS

[76] Inventor: Hisao Sato, 10, Toyotamaminami-3-chome, Nerima-ku, Tokyo, Japan

[21] Appl. No.: 62,326

[22] Filed: Jul. 31, 1979

Related U.S. Application Data

[62] Division of Ser. No. 949,444, Oct. 10, 1978, Pat. No. 4,182,474.

[51] Int. Cl.[3] ..... G09F 3/12

[52] U.S. Cl. ..... 40/2 R; 40/20 A

[58] Field of Search ..... 40/2 R, 20 R, 20 A, 40/300, 301

[56] References Cited

U.S. PATENT DOCUMENTS

| | | | |
|---|---|---|---|
| 1,174,299 | 3/1916 | Taylor | 40/300 |
| 1,892,580 | 12/1932 | Lester | 40/300 |
| 2,232,732 | 2/1941 | Rogers | 40/2 R |
| 2,490,496 | 12/1949 | Williamson | 40/2 R |
| 2,847,774 | 8/1958 | Brooks | 40/2 R |

*Primary Examiner*—John F. Pitrelli

*Attorney, Agent, or Firm*—Norbert P. Holler

[57] ABSTRACT

Various tags, which are detachably connected to each other in a predetermined overlapping relationship to form a stick of tags and which are adapted to be used in a stapler that includes a staple magazine loaded with conventional staples and a tag magazine detachably connected to the bottom of the staple magazine and loaded with such a stick of tags, are disclosed. When a lever on the stapler is depressed, a staple driver drives the foremost staple of the staple stick in the staple magazine into and through the foremost one of the stick of tags in the tag magazine, detaching it from the stick, and further into one or more works so as to attach the tag to the work or works.

26 Claims, 22 Drawing Figures

TAGS FOR USE WITH STAPLERS

This is a division of application Ser. No. 949,444, filed Oct. 10, 1978 now U.S. Pat. No. 4,182,474.

BACKGROUND OF THE INVENTION

The present invention relates to tags adapted for use with a stapler which is loaded with a row of staples and a plurality of tags arranged in overlapped relation and in which when a lever is depressed, the foremost staple of the row of staples is driven through the foremost tag of the overlapped tags into a work, whereby a tag is attached to the work simultaneously when the work is fastened with a staple.

In order to attach a tag to a work such as a sheet of paper and the like with a conventional stapler for commercial or other purpose, after the tag has been placed on the work, the stapler is brought to a predetermined position relative to the tag placed on the work and operated to drive a staple into the tag and the work. This procedure is troublesome and time-consuming especially when it must be repeated.

SUMMARY OF THE INVENTION

One of the objects of the present invention is therefore to provide a stapler loaded with both a stick of staplers and a stick of tags so that when a staple is driven into a work, a tag is fed between the staple and work, whereby the tag may be automatically attached to the work.

Another object of the present invention is to provide a stapler of the type described above wherein the tag magazine is detachably attached to the bottom of the staple magazine and when a staple driver forces the foremost staple downwards out of the staple magazine, the staple is driven through the foremost tag or the staple passes through previously formed holes of the tag, while detaching the foremost tag from the stick of tags to feed the same onto a work, whereby the tag and work may be attached together.

A further object of the present invention is to provide tags best adapted for use with the stapler of the type described above.

In this specification, the term "tag" refers to a piece of flat plate or sheet of paper, high molecular compounds such as plastics and synthetic rubber, metal, glass, ceramic, leather, man-made leather, fibers, felts, woods, bamboos, other natural products and combinations thereof.

The tags in accordance with the present invention may be used for various purposes as will be described below.

(1) They may be used as index tags, labels, name cards, price tags, sticker and so on. That is, the tags marked, recorded or colored with letters, numerals and symbols may be attached to works such as documents and clothes. Alternatively, after the tags have been attached to the works, they may be marked, recorded or colored with letters, numerals, symbols, legends and so on.

(2) The tags may have holes or hook-shaped recesses as will be described in detail hereinafter so that the works such as posters and bags containing light weight articles of commerce may be hung or suspended.

(3) The tags may be also used as samples of articles of commerce. That is, an article of commerce in a thin form may be attached to a tag which in turn is attached to a work. Alternatively, after a tag has been attached to a work, an article of commerce may be attached to the tag. Furthermore a tag which is a sample of an article of commerce may be attached to a work.

(4) Chemical compounds such as insecticides may be applied to the tags which in turn may be attached to desired positions. Alternatively, chemical compounds may be applied to the tags which have been attached to suitable positions.

(5) The tags may be made of plate- or sheet-like members exhibiting desired electrical and/or mechanical properties and may be attached to desired positions.

(6) In addition, the tags may be used in the combinations of the above uses.

The above and other objects, features and advantages of the present invention will become more apparent from the following description of preferred embodiments thereof taken in conjunction with the accompanying drawings, in which:

BRIEF DESCRIPTION OF THE DRAWINGS

Same reference numerals are used to designate similar parts throughout several figures.

DESCRIPTION OF THE PREFERRED EMBODIMENTS

Figure 1A:
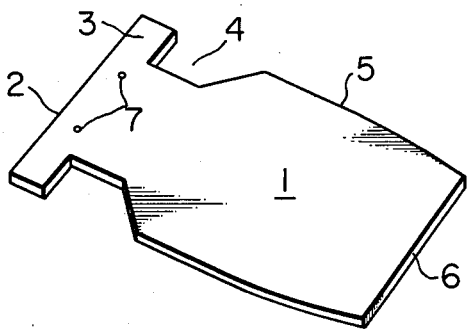
FIG. 1A is a perspective view of a first embodiment of a tag in accordance with the present invention.

Referring first to FIG. 1A, the first embodiment 1 of tags in accordance with the present invention is a piece of flat plate or sheet and is symmetrical about its longitudinal axis. (The same is true for the second, the third and the fourth embodiments). The front or leading portion 2 has laterally extended projections 3 contiguous with recessed portions 4 merging with straight or curved sides 5 which in turn merge with the rear or trailing edge 6. The legs of a staple are driven into the tag 1 at the points 7, but when the tag 1 is so hard that a staple cannot be driven, staple holes must be previously formed at 7. After or prior to the attachment of the tag 1, characters, numerals, symbols and marks may be recorded on either one or both of the major surfaces of the tag 1. Alternatively, a sample may be attached to the tag 1 as described previously.

Figure 12A:
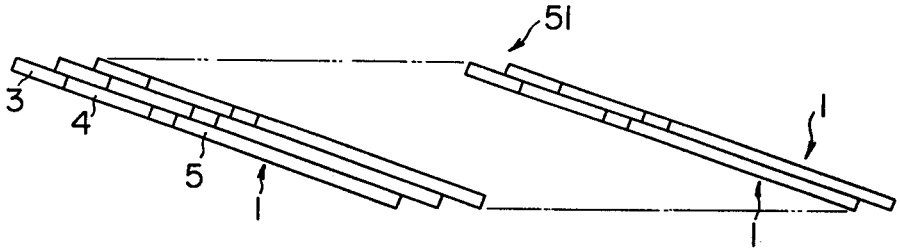
FIGS. 12A and 12B are side views of sticks of tags according to the present invention.

The tags are arranged in the form of a stick 51 when loaded into a stapler. To this end a plurality of tags 1 are stacked one over another in a predetermined overlapping relationship in series and interconnected with each other with a suitable adhesive or the like as shown in FIG. 12A.

Figure 1B:
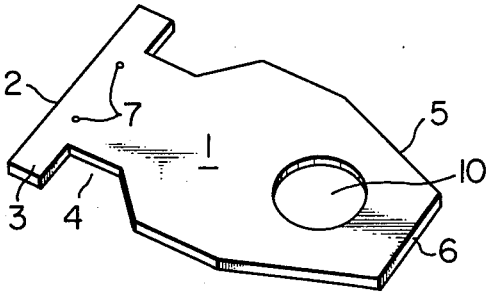
FIGS. 1B and 1C are perspective views of first and second modifications thereof.

FIG. 1B shows a modification of the tag 1 shown in FIG. 1A. Same reference numerals as those used in FIG. 1A are used to designate similar parts. The tag 1 shown in FIG. 1B is substantially similar in shape to the tag 1 shown in FIG. 1A except that the former is formed with a hole 10 used for hanging or suspending the tag 1. The hole 10 may be of any suitable form.

Figure 1C:
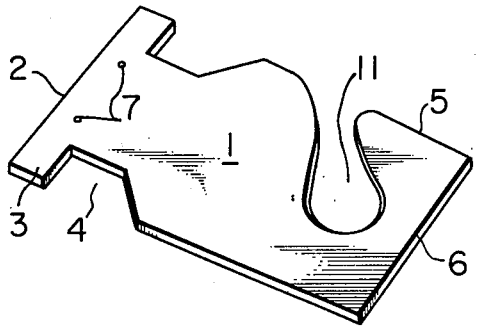

FIG. 1C shows another modification of the first embodiment shown in FIG. 1A which is substantially similar in shape to the first embodiment except that the modification is formed with a hook-shaped notch 11.

Figure 2A:
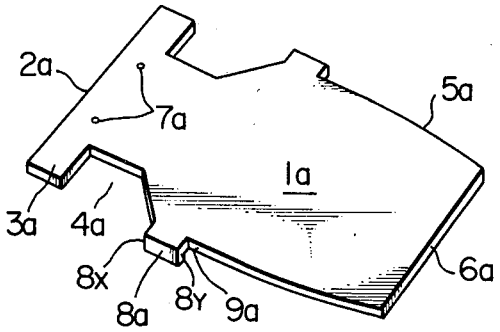
FIG. 2A is a perspective view of a second embodiment of a tag in accordance with the present invention.
Figure 2B:
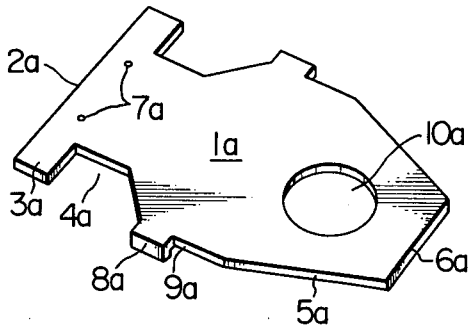
FIGS. 2B and 2C are perspective views of first and second modifications thereof.
Figure 2C:
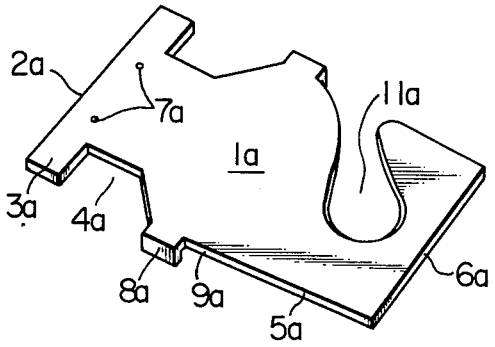
Figure 12B:
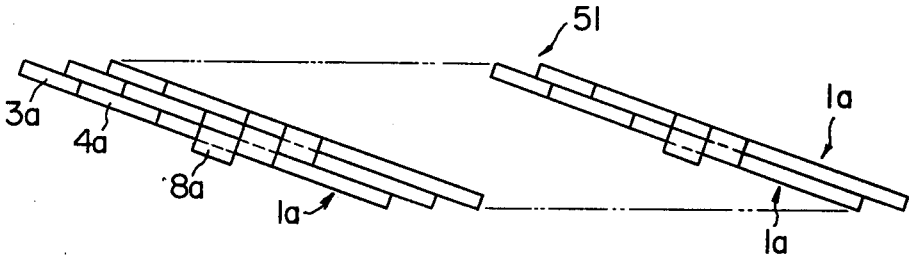

In the second embodiment and its modifications shown in FIG. 2A, FIG. 2B and FIG. 2C, respectively, the reference numerals used in FIGS. 1A, 1B and 1C are added with a suffix a to designate similar parts. A tag 1*a* of the second embodiment is substantially similar in shape to the first embodiment except that retaining legs 8*a* and retaining leg engaging portions 9*a* are formed. When the tag 1*a* is punched out or otherwise formed, the retaining legs 8*a* are initially in the form of flaps extended laterally. Thereafter they are bent downwards substantially at right angles with respect to the top major surface of the tag 1*a*. When a plurality of tags 1*a* are stacked one over another in the form of a stick in the manner described above, the retaining legs 8*a* of the tags 1*a* are fitted over the engaging portions 9*a* of the adjacent tags 1*a* so that the tags 1*a* may be interconnected with each other to form a stick 51 of tags as shown in FIG. 12B. Of course the surfaces of the retaining legs 8*a* and the engaging portions 9*a* to be brought into contact with each other are so processed as to facilitate the engagement of the retaining legs 8*a* with the engaging portions 9*a*, thereby securely interconnecting the adjacent tags 1*a*. The retaining forces produced by the engagement of the retaining legs 8*a* with the engaging portions 9*a* are dependent upon the length and bending angle of the retaining legs 8*a*. In general, the length of the retaining legs 8*a* equals the thickness of the tag 1*a*. The front end surface or edge 8*x* adjacent to the recess 4*a* of the retaining leg 8*a* is made into contact with the rear end surface or edge 8*y* of the adjacent tag 1*a* when stacked one over another in the manner described above so that the adjacent tags 1*a* are interconnected with each other with a predetermined shift. This shift is substantially equal to the width of the retaining leg 8*a*; that is, the distance between the front and rear ends 8*x* and 8*y* thereof; and remains unchanged when the stick 51 of tags is loaded in a stapler and pushed forward by a tag pusher 44 as will be described in detail hereinafter with reference to FIG. 6.

The first modification of the second embodiment shown in FIG. 2B is substantially similar in construction to the second embodiment shown in FIG. 2A except that a hole 10*a* in any suitable form is provided for suspending or hanging the tag 1*a*.

The second modification of the second embodiment shown in FIG. 2C is also substantially similar in construction to the second embodiment shown in FIG. 2A except that a hook-shaped recess 11*a* is provided.

Figure 3A:
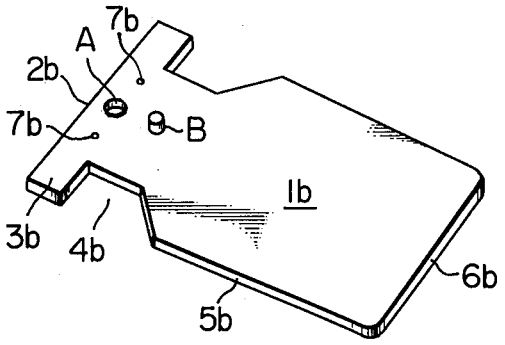
FIG. 3A is a perspective view of a third embodiment of a tag in accordance with the present invention.
Figure 3B:
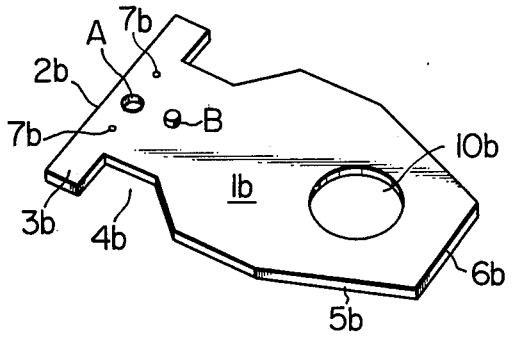
FIGS. 3B and 3C are perspective views of first and second modifications thereof.
Figure 3C:
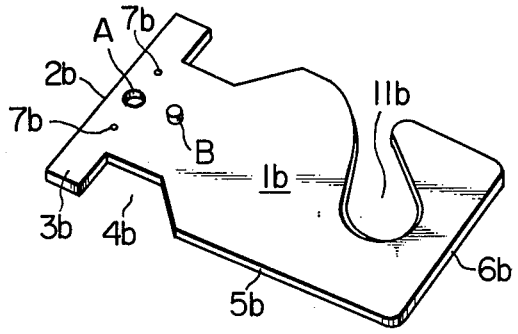

In the third embodiment and its modifications shown in FIGS. 3A, 3B and 3C, the reference numerals used in FIG. 1A are added with a suffix b to designate similar parts. The third embodiment shown in FIG. 3A is substantially similar in construction to the first embodiment shown in FIG. 1A except that a tag 1*b* is formed with a retaining hole A and a retaining projection B. Preferably these hole A and projection B are positioned along the longitudinal axis of the tab 1*b* and spaced apart from each other by a predetermined distance. Thus when a plurality of tags 1*b* are stacked one over another into a form of a stick as shown in FIG. 12A, each of the retaining projections B is fitted into the mating retaining hole A of the adjacent tags 1*b* so that the tags may be securely interconnected with each other. The shift between the adjacent tags 1*b* is substantially equal to the distance between the engaging hole A and the engaging projection B. It should be noted that the positions of the engaging hole A and the engaging projection B may be reversed. The engaging hole A may be a through hole or a blind hole and the retaining projection B may be extended from the undersurface of the tag 1*b* rather than from the upper surface as shown. With the mating hole A being a blind hole, the height of the projection B must be less than the thickness of the tag 1*b*. On the other hand when the retaining hole A is a through hole, the height of the retaining projection B may be slightly longer than the thickness of the tag 1*b*. In either case, it is preferable that the adjacent tags 1*b* are made into intimate face to face contact with each other when stacked or overlapped as shown in FIG. 12A.

The first modification shown in FIG. 3B is substantially similar to the third embodiment shown in FIG. 3A except that a hole 10*b* is provided in order to hang or suspend the tag 1*b*. The second modification shown in FIG. 3C is also substantially similar in construction to the third embodiment shown in FIG. 3A except that a hook-shaped recess 11*b* is formed.

Figure 4:
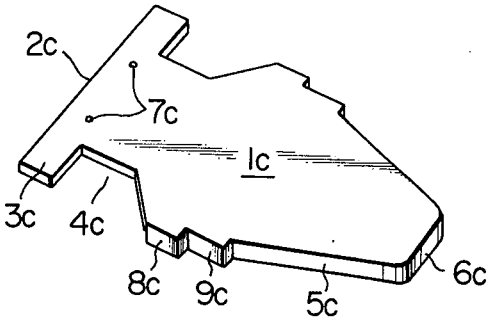
FIG. 4 is a perspective view of a fourth embodiment of a tag in accordance with the present invention.

In FIG. 4 showing the fourth embodiment of the present invention the reference numerals used in FIG. 1A are added with a suffix c to designate similar parts. The fourth embodiment is substantially similar in construction to the second embodiment shown in FIG. 2A except that the retaining leg engaging portions 9*c*, sides 5*c* and the rear end or edge 6*c* are bent in a manner substantially similar to that of the retaining legs 8*c*. When a plurality of tags 1*c* are stacked one over another to form a stick of tags, the retaining legs 8*c* are fitted over the engaging portions 9*c* of the adjacent or underlying tag so that the tags may be interconnected with each other in the like manner as shown in FIG. 12B. As with the modifications of the first, second and third embodiments, the fourth embodiment may be provided with a hole or a hook-shaped recess.

Next prior to the description of a stapler in accordance with the present invention, a prior art stapler will be described briefly with reference to FIG. 5. It includes a base 12 and a magazine 13 loaded with a stick 52 of staples and a driver-/operating lever 14 which are pivoted with a pivot pin 24 on the base 12 at the point adjacent to the rear or right end thereof for pivotal movement about the pin 24 with respect to the base 12 and with each other. A clinching groove 15 is formed on the base 12 adjacent to the front end thereof. One end of a large leaf spring 16 is spot welded or otherwise joined to the base 12 at a point adjacent to the rear end thereof while the other end of the leaf spring 16 is made into contact with the undersurface of the staple magazine 13 so as to normally bias the same upwardly of the base 12. The staple magazine 13 is formed in an inverted U-shape in cross section and has a bottom 13*a*, laterally spaced side walls 13*b* and a front wall 13*c*. A pair of longitudinally spaced apart projections 17 and 17*a* are extended from the top of the bottom 13*a* and a guide rod 18 is extended longitudinally of the magazine 13 and has its both ends securely fitted into holes of the projections 17 and 17*a*. The guide rod 18 is slidably fitted into a hole formed through an upright portion of a staple pusher 19. A helical compression spring 20 is fitted over the guide rod 18 between the staple pusher 19 and the rear projection 17*a* so as to normally bias the staple pusher 19 forwards or in the left direction in FIG. 5. A throat 21 is formed through the bottom plate 13*a* immediately behind the front wall 13*c* of the staple magazine 13 so that the foremost staple of the staple stick 52 loaded between the front wall 13*c* of the magazine 13 and the staple pusher 19 may be driven through the throat 21 into a work.

The upper end of a staple driver 22 and the front end of a leaf spring 23 are securely attached to the undersurface of the driver-operating lever 14 adjacent to the front end thereof. In FIG. 5, the staple driver 22 and the leaf spring 23 are shown as being in unitary construction, but as described above they may be formed separately. The lower or rear end of the leaf spring 23 is abutted against the upper side edges of the side walls 13*b* of the staple magazine 13. Thus the leaf spring 23 normally biases the staple magazine 13 downwards.

Figure 5:
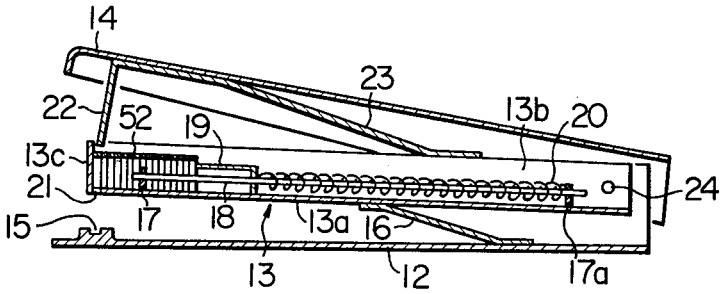
FIG. 5 is a longitudinal sectional view of a prior art stapler.

The stapler shown in FIG. 5 uses a stick 52 of staples of conventional form. A work is interposed between the base 12 and the magazine 13 or more particularly between the clinching anvil 15 and the staple throat of the magazine 13. When the driver-operating lever 14 is depressed downwards, the staple driver 22 forces the foremost staple in the magazine 13 to drive through the throat 21 into the work and is clinched by the clinching anvil or groove 15 over the undersurface of the work.

The stapler in accordance with the present invention is an improvement of the prior art type stapler of the type described above. That is, the works may be fastened together with a staple and a tag of the types described elsewhere or a tag may be attached to a work with a staple as will be described in detail hereinafter.

In FIGS. 6–11 the reference numerals same with those used in FIG. 5 are used to designate similar parts. The stapler in accordance with the present invention includes the staple magazine 13, the driver-operating lever 14, the clinching anvil or groove 15, the pair of guide rod supporting projections 17 and 17*a*, the staple guide rod 18, the staple pusher 19, the compression spring 20 loaded between the projection 17*a* and the staple pusher 19, the staple throat 21, the staple driver 22, the leaf spring 23 and the pivot pin 24. These parts have been already described in detail so that no further description shall be made.

Figure 7:
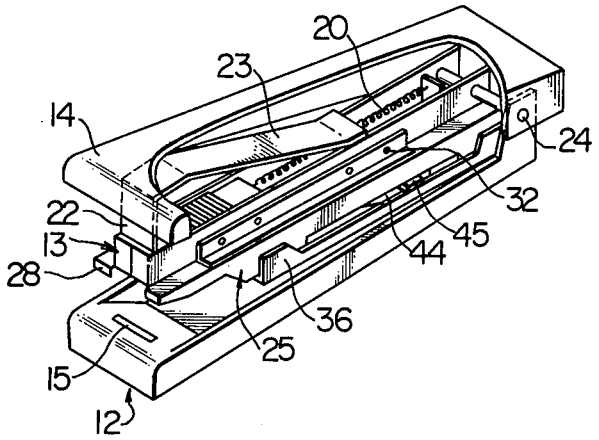
FIG. 7 is a perspective view, partly broken, thereof.
Figure 8:
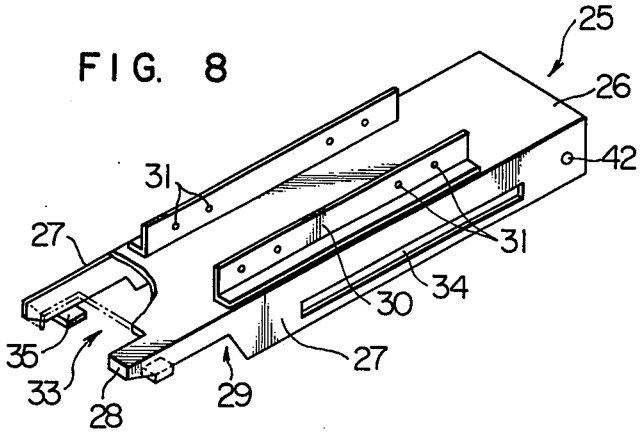
FIG. 8 is a perspective view, partly broken, of a tag magazine.

Referring to FIG. 8, a tag magazine generally indicated by 25 has a top wall 26, side walls 27 depending from the top wall 26 and front engaging projections 28. A stick of tags is loaded in a storage chamber 29 defined by the top wall 26 and the side walls 27. L-shaped staple magazine retaining members 30 are spot welded or otherwise joined to the upper surface of the top wall 26 of the tag magazine 25 and spaced apart laterally from each other by a predetermined distance slightly greater than the width of the staple magazine. Retaining holes 31 are formed through the upright or vertical portion of each retaining member 30 and are spaced apart from each other by a suitable distance in the longitudinal direction. The tag magazine 25 is mounted on or attached to the bottom of the staple magazine 13 as shown in FIG. 7. To this end the side walls 13*b* of the staple magazine 13 are provided with a plurality of retaining projections 32 adapted to mate with the retaining holes 31 of the retaining or clamping members 30. When the tag magazine 25 is attached to the staple magazine 13, these retaining projections 32 fit into the corresponding retaining holes 31 of the retaining or clamping members 30 so that the tag magazine 25 may be securely connected to the staple magazine 13. It should be noted, however, that any other suitable means and arrangements may be used for releasably attaching the tag magazine 25 to the staple magazine 13.

An opening 33, which is for instance rectangular in shape, is formed through the top wall 26 of the tag magazine 25 adjacent to the front end thereof so that a staple may be driven through this opening 33. The side walls 27 of the tag magazine 25 are formed with longitudinally elongated guide slots 34 for guiding a tag pusher 44 to be described in detail hereinafter with reference to FIGS. 10A and 10B. The forward or front portions of the side walls 27 are stepped as best shown in FIG. 8 and tag support projections 35 are extended laterally inwardly in opposed relationship from the stepped portions and inclined at an angle to the horizontal in such a way that the leading edge of the foremost tag of the stick 51 of tags may be supported and guided by the tag support projections 35. Spaced forewards from the tag support projections 35, the front engaging portions 28 are extended vertically downwardly from the front end of the top wall 26 of the tag magazine 25 and laterally inwardly from the front ends of the side walls 27. When the stick 51 of tags is loaded into the tag magazine 25, the leading edge of the foremost tag is made into abutment with the front engaging projections 28 of the side walls 27. The position and size of the tag support projections 35 are so selected that when the foremost tag is depressed downwards as will be described in more detail hereinafter each projection 3, 3*a*, 3*b* or 3*c* of a tag 1, 1*a*, 1*b* or 1*c* passes between the rear surface of the associated front engaging projection 28 and the front edge of the associated tag support projection 35 and the recess 4, 4*a*, 4*b* or 4*c* passes past the associated projection 35.

Figure 9:
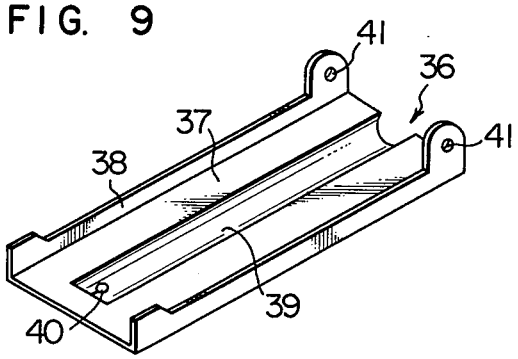
FIG. 9 is a perspective view of a bottom cover of the tag magazine.

Referring to FIG. 9, the tag magazine 25 includes a bottom cover generally indicated by the reference numeral 36. It has a bottom wall 37 and laterally spaced apart side walls 38. A spring receiving groove 39 semicircular in cross section is partially extended along the longitudinal axis of the bottom plate 37 for receiving therein a coiled tension spring 49 to be described in more detail hereinafter with reference to FIG. 6. A spring retainer 40 is attached to the front end of the spring receiving groove 39. The bottom cover 36 with the above construction is pivoted to the tag magazine proper 25 with pivot pins 43 which are fitted into holes 41 at the rear ends of the side walls 38 of the bottom cover 36 and into holes 42 formed through the side walls 27 of the tag magazine 25. Thus the tag magazine proper 25 and the bottom cover 36 may be swung about the pivot pins 43 with respect to each other.

Figure 10A:
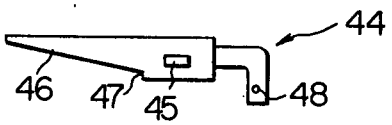
FIG. 10A is a side view of a tag pusher.
Figure 10B:
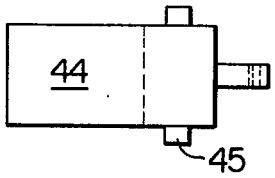
FIG. 10B is a top view thereof.

Next referring to FIGS. 10A and 10B, a tag pusher generally indicated by the reference numeral 44 has a pair of projections 45 extended laterally outwardly from the side surfaces and slidably fitted into the guide grooves 34 of the side walls 27 of the tag magazine 25 (See FIG. 8). The bottom surface of the tag pusher 44 is stepped at 47 and is gradually tapered upwardly toward the front end of the pusher 44 as best shown in FIG. 10A. In operation, the upper surface of the rearmost tag is made into contact with the inclined surface 46 and the trailing end or rear edge 6 of the tag is made into contact with the stepped pushing portion 47. A second spring retainer 48 is projected from the rear end surface of the tag pusher 44. The coiled tension spring 49 is loaded between the first and second spring retainers 40 and 48.

Figure 6:
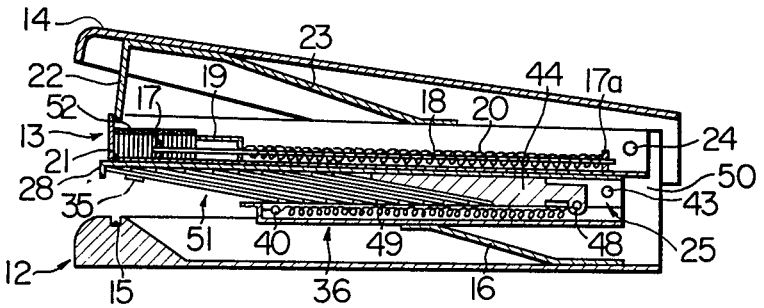
FIG. 6 is a longitudinal sectional view of an embodiment of a stapler in accordance with the present invention.

Since the tag magazine 25 is attached to the bottom wall of the staple magazine 13 and the bottom cover 36 is pivoted to the tag magazine 25 so as to close the open bottom thereof as described in detail hereinbefore, the upright portion 50 (See FIG. 11) of the base 12 is made higher than that of the prior art stapler shown in FIG. 5. Therefore, when the base 12, the staple magazine 13, the driver-operating lever 14, and the tag magazine 25 with the bottom cover 36 are assembled, a space is available for disposing the leaf spring 16 which is normally made into contact with the bottom plate 37 of the bottom cover 36 so as to bias it upwardly of the base 12 as best shown in FIG. 6.

Next the mode of operation of the stapler with the above construction will be described. A stick 52 of staples (which will be sometimes referred to as "the staple stick 52") may be loaded in the stapler in a manner substantially similar to that when the prior art stapler is used. That is, the stapler magazine 13 is swung about the pivot pin 24 away from the driver-operating lever 14, and thereafter the staple pusher 19 is retracted backwardly against the compression spring 20. The staple stick 52 is loaded into the space thus provided between the front wall 13*c* of the staple magazine 13 and the staple pusher 19, and thereafter the staple magazine 13 is swung back about the pivot pin 24 toward the lever 14.

Figure 11:
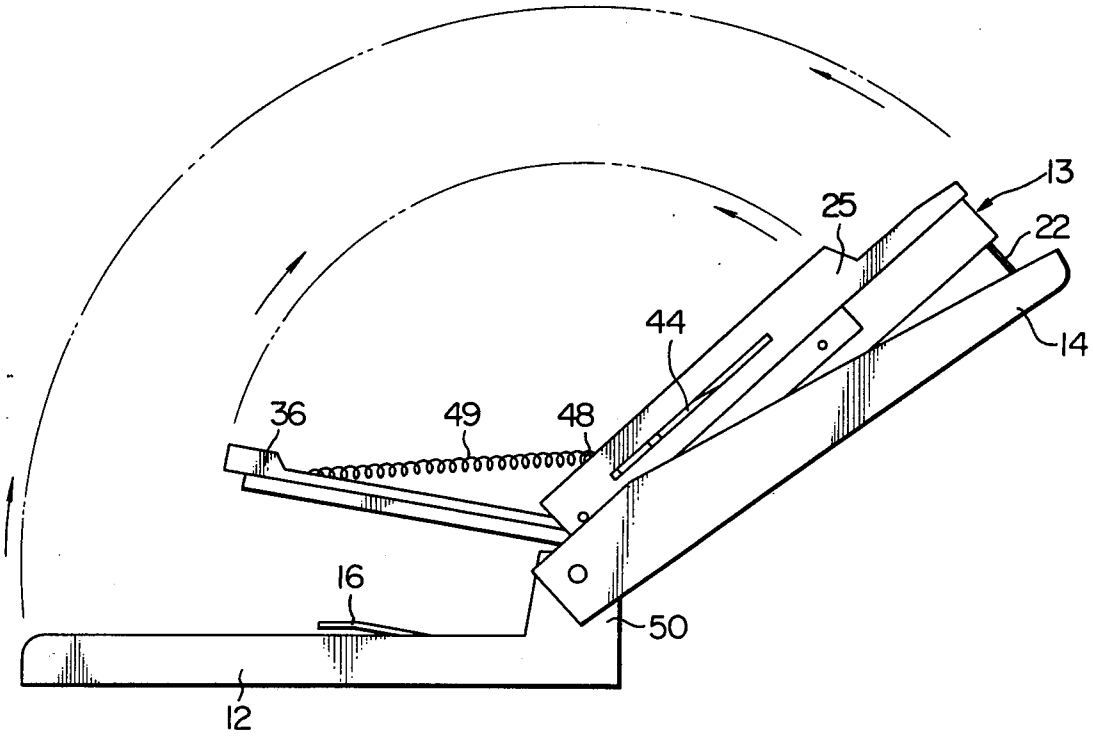
FIG. 11 is a side view of the stapler with the bottom cover swung away from the tag magazine proper in order to load a stick of tags.

To load the stick 51 of tags (which will be referred to as "the tag stick 51"), the tag magazine 25 is swung about the pivot pin 24 away from the base 12 and then the bottom cover 36 is swung about the pivot pin 42 away from the tag magazine 25 as best shown in FIG. 11. As the bottom cover 36 is swung away, the tag pusher 44 is displaced backwardly under the force of the tension spring 49. The tag stick 51 is loaded into the storage chamber 29 with the leading or front edge 2 of the foremost tag directed toward the front end of the tag magazine 25. Thereafter the tag magazine 25 is closed with the bottom cover 36 and then the tag magazine 25 with the bottom cover 36 is swung toward the base 12 as shown in FIG. 6. In this position, the tag pusher 44 is forced to move forwards under the force of the tension spring 49 so that the inclined surface 46 of the pusher 44 is made into contact with the upper surface of the rearmost tag and the pushing portion 47 is made into contact with the trailing edge 6 of the rearmost tag. Thus the tag stick 51 is imparted with the force of the tension spring 49 which tends to move the stick 51 forwards so that the leading edge 2 of the foremost tag is made into abutment with the front engaging projections 28 of the tag magazine. Thus the loading of the tag stick 51 is completed.

The mode of operation will be described hereinafter in connection with the attachment of a tag 1 to a work with a staple. The portion of the work to which a tag is to be attached is placed on the clinching anvil 15 on the base 12 and the driver-operating lever 14 is depressed downwards. Since the leaf spring 23 is stronger than the leaf spring 16, the lever 14, the staple magazine 13 and the tag magazine 25 are swung downwards about the pivot pin 24 in unison with each other so that the foremost tag of the stick 51 in the tag magazine 25 is brought into contact with or close to the work. When the lever 14 is further depressed downwards, the staple driver 22 is forced to move downwards against the force of the leaf spring 23, driving the foremost staple of the stick 52 through the throat 21 of the staple magazine 13 and the upper opening 33 of the tag magazine 25. The driven staple is first made into contact with the foremost tag 1 of the stick 51 in the tag magazine 25 at the points 7 (See FIG. 1A) and drives the front or leading edge 2 of the tag downwards along the inner surfaces of the front engaging projections 28 while the recess 4 of the tag 1 passing past the tag support projections 35. In this case, the tag support projections 35 are in engagement with the leading edge 2 of the next tag 1 so that the latter cannot be drived downwards. Therefore the foremost tag 1 is separated from the succeeding or next tag and is pressed against the work. When the lever 14 is further depressed, the foremost staple is driven through both the foremost tag 1, which is now separated from the tag stick 51, and the work and the legs of the staple are clinched by the clinching anvil over the undersurface of the work. Thus the tag 1 is completely attached to the work.

When the tag 1 is of a nature that the staple may be easily driven therethrough or formed with the staple holes 7, the legs of the staple pass through the tag or those holes before the foremost tag 1 is separated from the next tag.

When the driver-operating lever 14 is released, the lever 14, the staple magazine 13 and the tag magazine 25 are all swung upwards under the force of the leaf springs 16 and 23 and the next staple and the next tag are stepped forwards under the forces of the compression spring 20 and the tension spring 40 to their operative positions as shown in FIGS. 6 and 7.

As described above, with the stapler in accordance with the present invention, the tag 1 may be securely attached to the work with the staple only by one depression of the lever 14. Thus the tags may be successively attached to the works.

Figure 13:
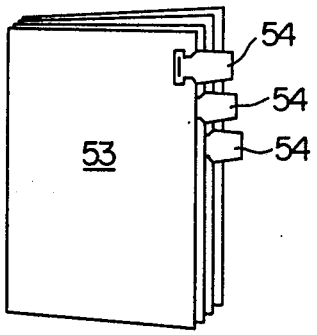
FIG. 13 shows the tags attached to desired pages of a document as index tags.

FIG. 13 shows that a tag of the present invention is attached to each sheet of paper 53 in a file as an index tag 54. It can be seen that with the tags attached to the sheets may be easily indexed.

Figure 14:
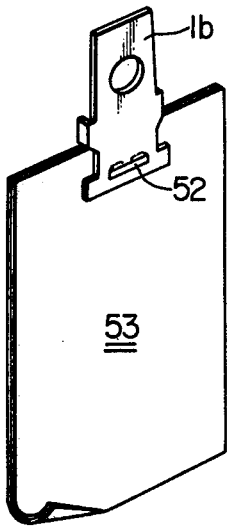
FIG. 14 shows a tag attached to a plurality of sheets of paper and formed with a hole for hanging or suspending the bound sheets of paper.

FIG. 14 shows that the tag 1*b* with the hole 10*b* attached to several sheets of paper 53 serves as a hanger for display or the like.

In addition, it is apparent to those skilled in the art that the tags in accordance with the present invention may be used for various purposes as described elsewhere.

While there has been described in connection with the preferred embodiments of the present invention it will be obvious to those skilled in the art that various changes and modifications may be effected without departing from the present invention, and it is aimed, therefore, to cover in the appended claims all such changes and modifications as fall within the true sprit and scope of the present invention.

What is claimed is:

1. For use with a stapler including a staple magazine having a staple throat at its front end, and further including a tag magazine located below said staple magazine and having a downward opening in its front end region underlying said staple throat and a pair of projections extending generally laterally inwardly of said downward opening from the opposite sides of said tag magazine at respective positions spaced rearwardly from the front end of said tag magazine;

a tag adapted to be stapled to at least one object, comprising:

a piece of flat plate or sheet having a front edge, a rear edge, and a pair of side edges, said tag being provided with a pair of recesses each extending inwardly from a respective one of said side edges at a position spaced rearwardly from said front edge of said tag by an amount corresponding to the rearward spacing of the corresponding one of said projections from said front end of said tag magazine, the depth of each of said pair of recesses in said tag being slightly greater than the lateral extent of the associated one of said pair of projections of said tag magazine, and said tag being constructed such that a plurality of said tags are adapted to be detachably connected to each other in a predetermined overlapping and staggered relationship in series, thereby to form a tag stick adapted to be slidably received in said tag magazine with only the front end region of the foremost one of said tags underlying said staple throat and overlying the region of said downward opening frontwardly of said projections.

2. A tag as set forth in claim 1 wherein a pair of retaining legs are formed each adjacent to the rear end of a respective one of said pair of recesses and each extending downwardly at right angles with respect to the upper surface of said tag, and respective portions of the side edges of said tag, which adjoin the rear ends of said pair of retaining legs and the longitudinal extents of which are substantially equal to the widths of said retaining legs, are transversely spaced apart from each other by a distance substantially equal to the distance between the inwardly directed surfaces of said pair of retaining legs.

3. A tag as set forth in claim 1 wherein a retaining hole and a retaining projection are formed in axial alignment with each other along the longitudinal axis of said tag and are spaced apart from each other by a predetermined distance, said projection being adapted to be fit into the retaining hole of an adjacent tag.

4. A tag as set forth in claim 1, 2 or 3 wherein a hole in any suitable shape is formed through said tag for the purpose of hanging or suspending said tag.

5. A tag as set forth in claim 1, 2 or 3 wherein a hook-shaped recess is formed in said tag for the purpose of hanging or suspending said tag.

6. A tag as set forth in claim 1 wherein said recesses are positioned at the same distance from said front edge.

7. In combination, a tag and an elongate tag magazine for a stapler, said tag magazine having a downward opening at least at its front end portion, and a pair of projections extending laterally inwardly of said downward opening from the opposite sides of said tag magazine at positions spaced rearwardly from the front end of said tag magazine, and said tag comprising a piece of flat plate or sheet having a front edge, a rear edge, and a pair of side edges and provided with a pair of recesses each extending inwardly from a respective one of said side edges at a position spaced rearwardly from said front edge by a predetermined distance substantially equivalent to the front to rear spacing of said projections from the front end of said tag magazine, the inwardmost edges of said pair of recesses being spaced apart from each other by a distance slightly less than the spacing of the innermost edges of said pair of projections from each other, said tag being constructed such that a plurality of said tags are adapted to be detachably connected to each other in a predetermined overlapping and staggered relationship in series, thereby to form a tag stick adapted to be slidably received in said tag magazine with only the front end region of the foremost tag overlying the space between the front end and said pair of projections of said tag magazine.

8. The combination as set forth in claim 7 wherein said tag has a pair of retaining legs formed each adjacent to the rear end of a respective one of said pair of recesses and each extending downwardly at right angles with respect to the upper surface of said tag, and respective portions of the side edges of said tag, which adjoin the rear ends of said pair of retaining legs and the longitudinal extents of which are substantially equal to the widths of said retaining legs, are transversely spaced apart from each other by a distance substantially equal to the distance between the inwardly directed surfaces of said pair of retaining legs.

9. The combination as set forth in claim 7 wherein said tag has a retaining hole and a retaining projection formed in axial alignment with each other along the longitudinal axis of said tag and spaced apart from each other by a predetermined distance, said projection being adapted to be fit into the retaining hole of an adjacent tag.

10. The combination as set forth in claim 7, 8 or 9 wherein said tag has a hole in any suitable shape formed therein for the purpose of hanging or suspending said tag.

11. The combination as set forth in claim 7, 8 or 9 wherein said tag has a hook-shaped recess formed therein for the purpose of hanging or suspending said tag.

12. The combination as set forth in claim 7 or 8, wherein said pair of projections in said tag magazine are arranged to be accommodated in and pass through said pair of recesses, respectively, of said foremost tag and to underlie the front edge of the tag immediately succeeding said foremost tag, whereby the foremost tag of a stick of tags can be removed from said tag magazine past said projections and through said downward opening while said projections retain the remainder of said stick of tags in said tag magazine.

13. The combination as set forth in claim 12 wherein the tags in said stick of tags are inclined forwardly at an angle relative to the horizontal, and said pair of projections have the top surfaces thereof inclined at the same angle as the angle of inclination of said tags in said stick of tags.

14. The combination as set forth in claim 7 or 8 wherein stop means are provided at the front end of said tag magazine for engagement with the front edge of the foremost tag of a stick of tags, and tag pusher means are provided for urging said foremost tag toward said front end of said magazine, said tag pusher means comprising a tag pusher disposed within said tag magazine for slidable movement in the longitudinal direction thereof and for engagement with the rear edge of the rearmost tag of said stick of tags when the same is loaded in said tag magazine, and a bias spring for normally biasing said tag pusher towards the front end of said tag magazine.

15. The combination as set forth in claim 14 wherein said tag pusher has an inclined surface adapted to be made into contact with the upper surface of said rearmost tag, and a tag pushing surface which is extended vertically from the lower edge of said inclined surface for engagement with the rear edge of said rearmost tag.

16. The combination as set forth in claim 15 wherein said tag magazine has a pair of side walls in which are formed respective elongated grooves, and said tag pusher has respective guide projections extending laterally outwardly from said tag pusher and slidably received in said grooves.

17. In combination with a stapler having a staple throat, a tag and an elongate tag magazine having a front end, said tag magazine having a downward opening at least at its front end region underlying said staple throat, and a pair of projections extending laterally inwardly of said downward opening from the opposite sides of said tag magazine at positions spaced rearwardly from the front end of said tag magazine, and said tag comprising a piece of flat plate or sheet having a front edge, a rear edge, and a pair of side edges and provided with a pair of recesses each extending inwardly from a respective one of said side edges at a position spaced rearwardly from said front edge by a predetermined distance substantially equivalent to the front to rear spacing of said projections from the front end of said tag magazine, the depth of each of said pair of recesses being slightly greater than the lateral extent of the associated one of said pair of projections, said tag being constructed such that a plurality of said tags are adapted to be detachably connected to each other in a predetermined overlapping and staggered relationship in series, thereby to form a tag stick adapted to be slidably received in said tag magazine with only the front end region of the foremost one of said tags underlying said staple throat.

18. The combination as set forth in claim 17 wherein said tag has a pair of retaining legs formed each adjacent to the rear end of a respective one of said pair of recesses and each extending downwards at right angles with respect to the upper surface of said tag, and respective portions of the side edges of said tag, which adjoin the rear ends of said pair of retaining legs and the longitudinal extents of which are substantially equal to the widths of said retaining legs, are transversely spaced apart from each other by a distance substantially equal to the distance between the inwardly directed surfaces of said pair of retaining legs.

19. The combination as set forth in claim 17 wherein said tag has a retaining hole and a retaining projection formed in axial alignment with each other along the longitudinal axis of said tag and spaced apart from each other by a predetermined distance, said projection being adapted to be fit into the retaining hole of an adjacent tag.

20. The combination as set forth in claim 17, 18 or 19 wherein said tag has a hole in any suitable shape formed therein for the purpose of hanging or suspending said tag.

21. The combination as set forth in claim 17, 18 or 19 wherein said tag has a hook-shaped recess formed therein for the purpose of hanging or suspending said tag.

22. The combination as set forth in claim 17 or 18 wherein said pair of projections in said tag magazine are arranged to be accommodated in and pass through said pair of recesses, respectively, of said foremost tag and to underlie the front edge of the tag immediately succeeding said foremost tag, whereby the foremost tag of a stick of tags can be removed from said tag magazine past said projections and through said downward opening while said projections retain the remainder of said stick of tags in said tag magazine.

23. The combination as set forth in claim 22 wherein the tags in said stick are inclined forwardly at an angle relative to the horizontal, and said pair of projections have the top surfaces thereof inclined at the same angle as the angle of inclination of said tags in said stick of tags.

24. The combination as set forth in claim 17 or 18 wherein stop means are provided at the front end of said tag magazine for engagement with the front edge of the foremost tag of a stick of tags, and tag pusher means are provided for urging said foremost tag toward said front end of said magazine, saig tag pusher means comprising a tag pusher disposed within said tag magazine for slidable movement in the longitudinal direction thereof and for engagement with the rear edge of the rearmost tag of said stick of tags when the same is loaded in said tag magazine, and a bias spring for normally biasing said tag pusher towards the front end of said tag magazine.

25. The combination as set forth in claim 24 wherein said tag pusher has an inclined surface adapted to be made into contact with the upper surface of said rearmost tag, and a tag pushing surface which is extended vertically from the lower edge of said inclined surface for engagement with the rear edge of said rearmost tag.

26. The combination as set forth in claim 25 wherein said tag magazine has a pair of side walls in which are formed respective elongated grooves, and said tag pusher has respective guide projections extending laterally outwardly from said tag pusher and slidably received in said grooves.

* * * * *